US005450896A

United States Patent [19]

Bertva et al.

[11] Patent Number: 5,450,896

[45] Date of Patent: Sep. 19, 1995

[54] TWO-PIECE HEADER

[75] Inventors: John T. Bertva, Colleyville; John M. McCrady; Scott L. Hutto, both of Burleson, all of Tex.

[73] Assignee: Wynn's Climate Systems, Inc., Fort Worth, Tex.

[21] Appl. No.: 186,674

[22] Filed: Jan. 25, 1994

[51] Int. Cl.[6] ..... F28F 9/02

[52] U.S. Cl. ..... 165/173; 165/174; 165/176; 165/153

[58] Field of Search ..... 165/153, 173, 174, 176

[56] References Cited

U.S. PATENT DOCUMENTS

| | | | |
|---|---|---|---|
| 4,825,941 | 5/1989 | Hoshino et al. | 165/176 |
| 4,938,284 | 7/1990 | Howells . | |
| 5,062,476 | 11/1991 | Ryan et al. . | |
| 5,107,926 | 4/1992 | Calleson . | |
| 5,125,454 | 6/1992 | Creamer et al. . | |
| 5,127,466 | 7/1992 | Ando . | |
| 5,186,248 | 2/1993 | Halstead . | |
| 5,190,100 | 3/1993 | Hoshino et al. . | |
| 5,205,349 | 4/1993 | Nagao et al. | 165/173 |
| 5,207,738 | 5/1993 | Dey | 165/153 |
| 5,226,490 | 7/1993 | Ryan et al. . | |
| 5,246,064 | 9/1993 | Hoshino et al. . | |
| 5,329,995 | 7/1994 | Dey et al. | 165/173 |

*Primary Examiner*—A. Michael Chambers

*Attorney, Agent, or Firm*—James E. Bradley; Grady K. Bergen

[57] ABSTRACT

A parallel flow condenser having a plurality of substantially flat, parallel flow tubes are positioned between oppositely disposed headers. The flow tubes provide fluid communication between the headers for cooling fluid which flows through the condenser. Each of the headers is formed from an inner member having an inner wall and a pair of longitudinally extending, parallel sidewalls which protrude outward from the inner wall. The parallel sidewalls terminate in outer edges. An outer member is provided having an outer wall and a pair of longitudinally extending attachment flanges which project inward from the outer wall. The attachment flanges are positioned between the parallel sidewalls of the inner member with the attachment flanges overlapping and joining one of the parallel sidewalls so that the inner and outer members are effectively joined together to form a fluid passage. The inner edges are spaced apart from each other a distance less than the width of each of the flow tubes so that the ends of the flow tubes contact the inner edges of the attachment flanges, which act as stops, to prevent the tubes from being inserted too far into the openings of the inner wall of the header.

18 Claims, 3 Drawing Sheets

TWO-PIECE HEADER

BACKGROUND OF THE INVENTION

1. Field of the Invention

This invention relates to a parallel flow heat exchanger, and in particular to a heat exchanger having a two-piece header.

2. Description of the Prior Art

Heat exchangers or condensers, such as those used for condensing refrigerant in automobile air conditioning units, have been constructed using a plurality of parallel flow tubes which are connected at each end to manifolds or headers. In one type the headers are generally cylindrical single-piece tubes. The tubes are typically formed by rolling a sheet into a tube configuration and brazing the seam. This type can be manufactured at high production rates, but the tooling required to form these headers is expensive. In another type, the header assembly is formed in two pieces, sometimes referred to as header and tank portions. The two pieces are assembled and brazed together. Generally, it is more difficult to achieve high production rates with the two-piece type, but the tooling is less expensive.

In both types, baffles or fluid partitions located within the headers divert refrigerant through banks of several of the parallel tubes so that the fluid is passed between the headers. By passing the fluid through several banks of the parallel flow tubes, the fluid can be passed over a large amount of surface area within a relatively small amount of space.

Because fluid partitions or baffles used in these condensers are located within the interior of the header, in the two-piece header, the partition is properly positioned before the header portions are joined together. Various techniques are used to retain the partition before the two portions of the header are joined, but improvements are needed.

The parallel flow tubes are normally inserted into slots formed in the header and then the assembly is brazed in a furnace. Often it is difficult to ensure that the flow tubes are inserted into the header the proper distance before brazing.

SUMMARY OF THE INVENTION

A parallel flow heat exchanger or condenser is provided with a plurality of substantially flat, parallel flow tubes. Each of the flow tubes has a width and opposite ends. The flow tubes are joined to a pair of oppositely disposed headers for providing fluid communication between the headers. Each of the headers is constructed from an inner member which has an inner wall and a pair of longitudinally extending, parallel sidewalls, each sidewall having a width. The parallel sidewalls project outward from opposite sides of the inner wall and terminate in outer edges. The inner wall has a plurality of openings which are longitudinally spaced apart for receiving the ends of the parallel flow tubes.

An outer member of the header pipe has an outer wall and a pair of longitudinally extending attachment flanges. Each of the attachment flanges projects inward from the outer wall and terminates in an inner edge. Each of the attachment flanges has a width and a thickness and is provided with a transverse or radial slot extending parallel to the flow tubes. The attachment flanges are positioned between the parallel sidewalls of the inner member with each attachment flange overlapping and joining one of the parallel sidewalls so that the inner and outer members are joined together. With the inner and outer members joined together, a fluid passage is formed for allowing fluid flow through the interior of the header.

A fluid partition plate having side edges which are received in the slots of the attachment flanges extends across the fluid passage for diverting fluid flow through the header. The inner edges of the attachment flanges are spaced apart a distance less than the width of each of the flow tubes so that the ends of the flow tubes contact the inner edges of the attachment flanges when the tubes are inserted into the openings of the inner wall.

Projecting inward from the outer wall of the outer member are a pair of longitudinally extending sidewall retaining members. The attachment flanges are located between and spaced apart from the sidewall retaining members to form a longitudinally extending groove between each of the retaining members and the attachment flanges. The longitudinally extending grooves receive the outer edges of the parallel sidewalls when the inner and outer members are joined together. Projecting outward from the outer wall of the outer member is a mounting flange which helps facilitate the mounting of the condenser or heat exchanger to an appropriate support structure.

DETAILED DESCRIPTION OF THE INVENTION

Figure 1:
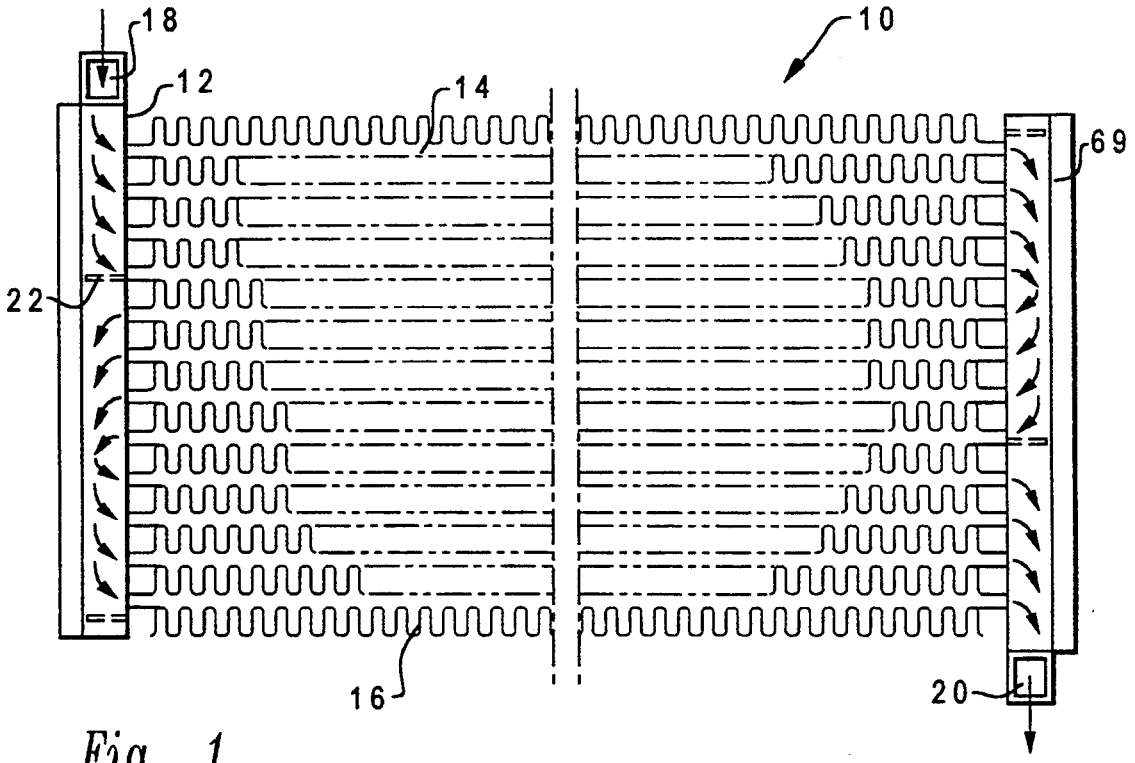
FIG. 1 is a side view of a air conditioning condenser constructed in accordance with the invention.
Figure 2:
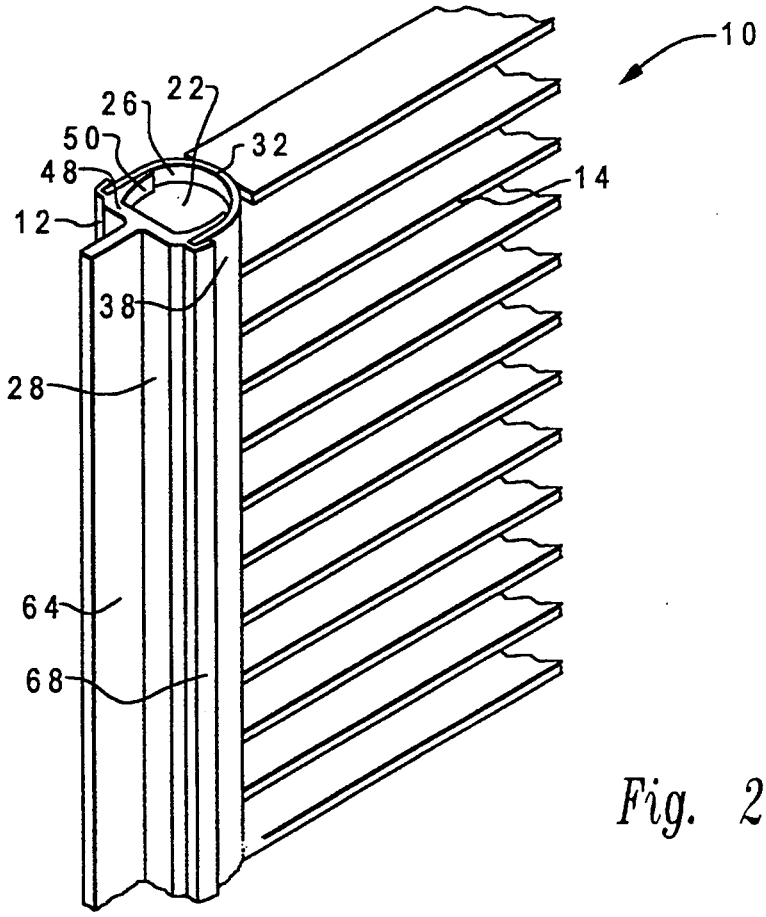
FIG. 2 is a partial perspective view of the air conditioning condenser of FIG. 1 showing a header constructed in accordance with the invention.

Referring to the figures, FIG. 1 shows an air conditioning condenser 10 for use in an automobile air conditioning unit. The condenser 10 has a set of oppositely disposed headers 12. A plurality of cross-flow tubes 14 are disposed between each of the headers 12. The cross-flow tubes 14 are substantially flat and are spaced apart and oriented parallel to each other. Located between and joined to each of the cross-flow tubes 14 are corrugated fins 16 which provide additional surface area for convective heat transfer.

The condenser 10 is provided with an inlet 18 for introducing high pressure refrigerant to be condensed into the condenser 10. The refrigerant flows through the condenser 10 and finally exits at outlet 20. Partition plates or baffles 22 located within the headers 12 direct the refrigerant through banks of the flow tubes 14.

Figure 3:
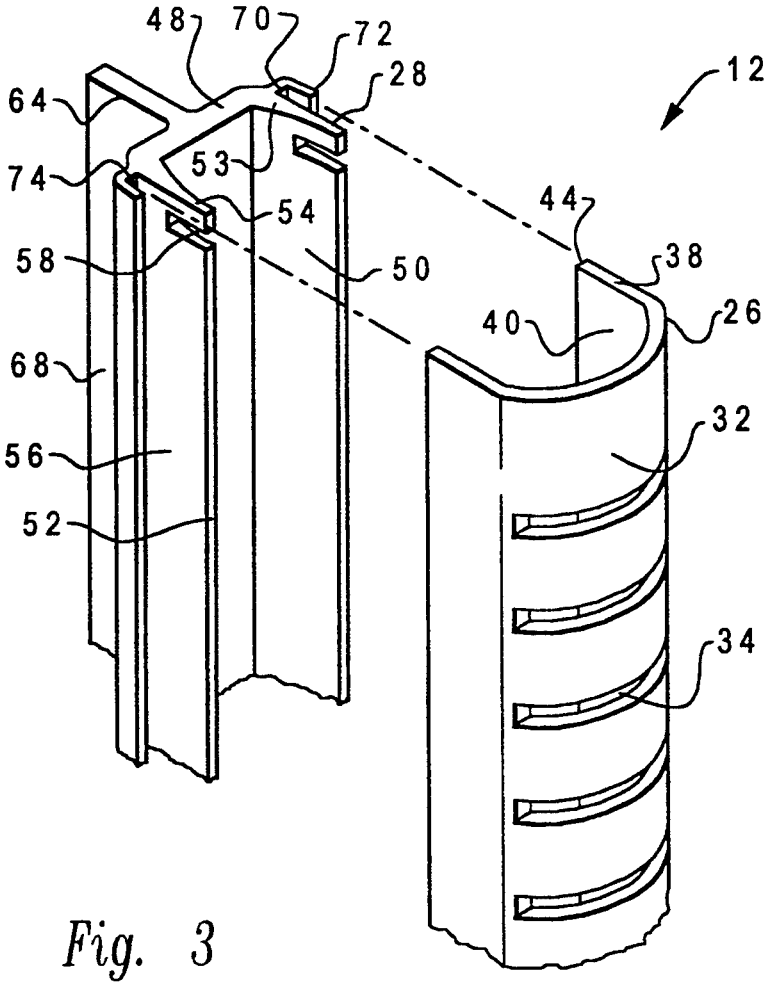
FIG. 3 is a perspective view of the header of FIG. 2 shown with inner and outer members exploded apart.
Figure 4:
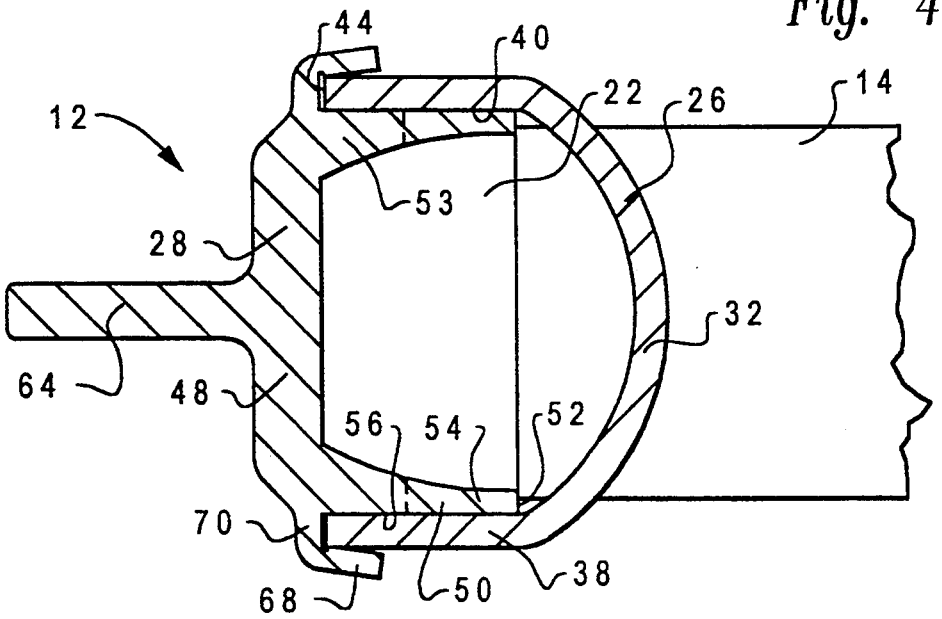
FIG. 4 is a cross-sectional view of the header of FIG. 2 taken perpendicular to its longitudinal axis.

Referring now to FIGS. 2–5, each header 12 is constructed from an inner member 26 and an outer member 28. It should be noted that the terms "inner", "inward", "outer" and "outward" are merely used herein for convenience, with "inner" or "inward" relating to the direction towards the center of the condenser 10 and "outer" or "outward" relating to the direction away from the center of the condenser 10. The inner member 26 has an inner wall 32 which is provided with a plurality of elongated, flat openings 34 (FIG. 3) which are longitudinally spaced apart. The inner member 26 is provided with a pair of longitudinally extending parallel sidewalls 38. The sidewalls 38 project outward from opposite sides of the inner wall 32 so that the inner member 26 has a substantially U-shaped cross section, as shown in FIG. 4. The sidewalls 38 terminate in outer edges 44 and have a width and a flat, interior attachment surface 40.

The outer member 28 has a substantially flat outer wall 48. A pair of longitudinally extending attachment flanges 50 project inward from the outer wall 48 and terminate at an inner edge 52. The attachment flanges 50 are substantially parallel to each other with the inner edges 52 being spaced apart a distance less than the width of the flow tubes 14. As seen in FIG. 4, the attachment flange 50 has a tapered portion 53 which decreases in thickness from the base of the attachment flange 50, where it is joined to the outer wall 48, towards the inner edge An inner portion 54 of the attachment flange 50 having a substantially uniform thickness extends from the tapered portion 53 to the inner edge 52. The exterior surface 56 of the attachment flange 50 is substantially flat and perpendicular to the outer wall 48.

A slot 58 is formed in each attachment flange 50, as shown in FIG. 3. The slot 58 extends transversely through the thickness of each attachment flange 50 parallel to the flow tubes 14 from the inner edge 52 toward the outer wall 48. The length of the slot 58 is less than the width of the attachment flange 50.

Figure 5:
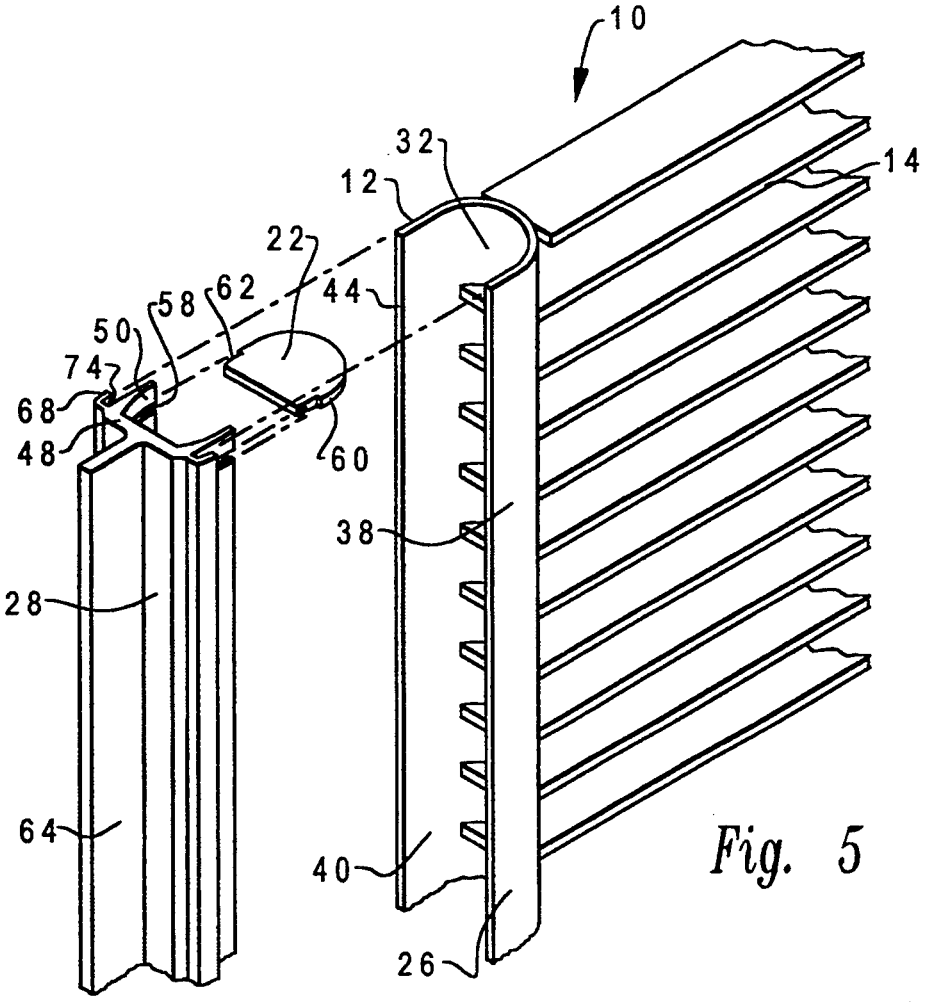
FIG. 5 is a partial perspective view of the condenser of FIG. 1 showing the outer member exploded away.

As shown in FIG. 5, a partition plate 22 is shown having side edges 60 which are received in the slots 58 of the attachment flanges 50 when the header 12 is formed. The partition plate is provided with notches defining a cut-out portion 62 which corresponds to and accommodates the tapered portion 53 of the attachment flanges 50 so that the partition plate 22 is closely received within the header 12.

When the inner and outer members 26, 28 are joined together, the attachment flanges 50 are positioned between the parallel sidewalls 38 of the inner member 26. The exterior surface 56 of each attachment flange 50 overlaps and joins the attachment surface 40 of one of the sidewalls 38 so that the inner and outer members 26, 28 are effectively joined together to form a fluid passage through the header 12. As shown in FIG. 4, the width of each attachment flange 50 is less than the width of the sidewalls 38 so that when the inner and outer members 26, 28 are joined together, the inner edge 52 of each attachment flange 50 is located alongside the outer wall 48 and spaced outward from the inner wall 32. The partition plate 22 extends across the fluid passage when the inner and outer members 26, 28 are joined together.

A rectangular mounting flange 64 extends outward from the outer wall 48 of the outer member 28. In the embodiment of FIGS. 1–5, the mounting flange 64 is located substantially in the center of the outer wall 48 and facilitates the mounting of the condenser 10 to an appropriate support structure. The mounting flange 64 may be provided with holes (not shown) for receiving bolts or fasteners.

Referring to FIG. 4, a pair of longitudinally extending sidewall retaining members 68 project inward from extended side portions 70 of the outer wall 48. The attachment flanges 50 are located between and spaced apart from the sidewall retaining members 68 so that a longitudinally extending groove 74 is located between each of the retaining members 68 and the attachment flanges 50. The longitudinally extending grooves 74 receive the outer edges 44 of the parallel sidewalls 38 when the inner and outer members 26, 28 are joined together.

The method of forming the air conditioning condenser 10 is as follows. The cross-flow tubes 14 are extruded from aluminum or an aluminum alloy using conventional methods. The extruded tubes are cut to the appropriate lengths.

Each of the headers 12 is also formed from aluminum or an aluminum alloy. The inner member 26 is formed from a flat plate. Holes are punched into the plate which is then bent until it has the U-shaped cross section as shown in FIG. 4. The outer member 28 is extruded so that it has a cross section as described above and shown in FIG. 4. The inner and outer members 26, 28 are also clad with a brazing compound. Slots 58 are cut, punched or otherwise formed on the attachment flanges 50 of the outer member 28.

Before joining the inner and outer members 26, 28 together, the partition plate or plates 22 are positioned between the inner and outer members 26, 28 with the side edges 60 being received within the slots 58. The inner and outer members 26, 28 are then positioned together with the outer edges 44 of the inner member 26 being received in the grooves 74 and the attachment flanges 50 of the outer member 28 being located between the sidewalls 38 of the inner member 26. When the inner and outer members 26, 28 are positioned together, the surfaces 40, 56 of the sidewalls 38 and attachment flanges 50 are in a contacting or near contacting relationship.

The ends of the flow tubes 14 are then inserted into the openings 34 formed in the inner wall 32 of the inner member 26, until the ends contact the inner edges 52 of the attachment flanges 50 with the corrugated fins 16 positioned between each the flow tubes 14. Because the inner edges 52 of the attachment flanges 50 are spaced apart a distance less than the width of the flow tubes 14, the ends of the flow tubes 14 contacting the inner edges 52 prevent the flow tubes 14 from being inserted further into the headers 12.

Next, the whole condenser assembly is heated in an oven to a temperature above the melting point of the brazing compound so that the components are brazed together. Components of the condenser 10 are thus effectively joined together with the flow tubes 14 being sealingly engaged with the openings 34 of the headers 12 and the fluid partition 22 sealing the flow passage formed by the inner and outer members 26, 28. Conventional fittings are added to form the inlet and outlets 18, 20 of the condenser 10. The condenser 10 may then be mounted and fastened to an appropriate support structure by means of the mounting flanges 64.

In operation, high pressure refrigerant which is to be condensed, is introduced into the inlet 18 of the condenser 10. The refrigerant flows through the flow passage of the header 12 where it is diverted by a first fluid partition or baffle 22 through a first bank of tubes 14. The refrigerant flows through the first bank of tubes 14 and into the opposite header 12. By positioning several fluid partitions 22 within the header pipes 12, the fluid can be passed back and forth between the header pipes 12 through several banks of tubes 14.

As the refrigerant flows through the condenser 10, air passing over the tubes 14 and fins 16 cools the refrigerant inside so that the refrigerant is completely condensed before exiting the condenser through outlet 20.

Figure 6:
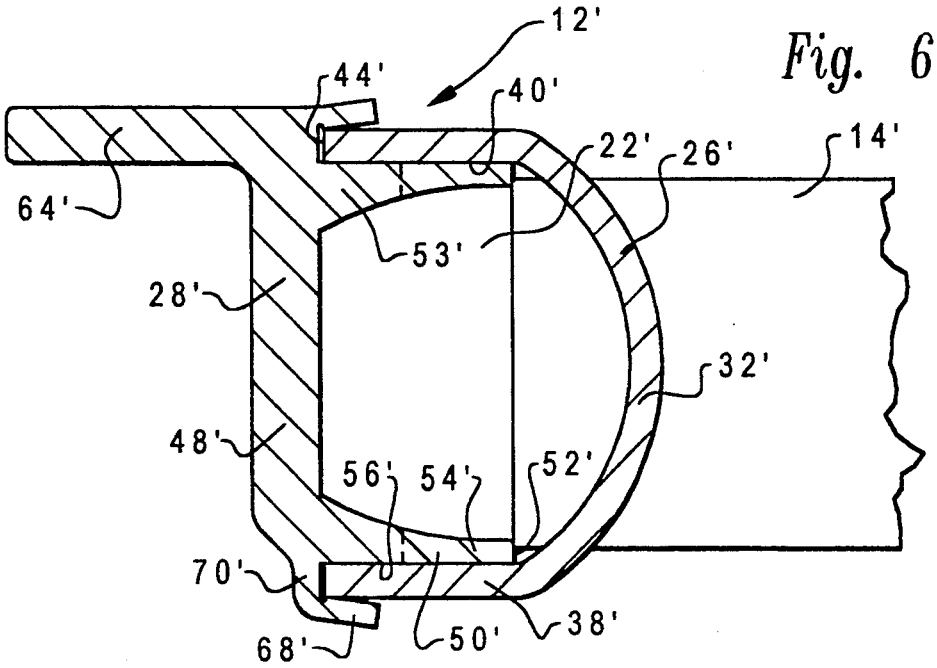
FIG. 6 is a cross-sectional view of another embodiment of a header taken perpendicular to its longitudinal axis and constructed in accordance with the invention.

In another embodiment of the condenser, a header 12', shown in FIG. 6, has a mounting flange 64' which is located to one side of the outer wall 48'. The components of the embodiment shown in FIG. 6 are substantially the same as those shown in FIGS. 1–5 but are designated with a prime sign. The method of forming the header 12' and its operation are similar to the header 12 in FIGS. 1–5.

The condenser of the invention has several advantages over the prior art. Because the header is formed from inner and outer members, the tooling is less expensive than single-piece headers. The inner and outer portions are easily assembled. The fluid partition can be easily positioned and retained in place within the slots formed in the attachment flanges prior to joining the inner and outer members together. The inner edges of the attachment flanges prevent further insertion of the flow tubes.

While the invention has been shown in only one of its forms, it should be apparent to those skilled in the art that it is not so limited, but is susceptible to various changes without departing from the scope of the invention.

We claim:

1. A parallel flow heat exchanger, comprising in combination:

a plurality of substantially flat, parallel flow tubes, each flow tube having a width and opposite ends; and a pair of oppositely disposed headers, the ends of each flow tube being joined to the headers for providing fluid communication between the headers, each header comprising in combination:

an inner member having an inner wall and a pair of longitudinally extending, parallel sidewalls which project outward from opposite sides of the inner wall and terminate in outer edges, each of the sidewalls having a width, the inner wall having a plurality of openings which are longitudinally spaced apart for receiving the ends of the parallel flow tubes;

an outer member having an outer wall and a pair of longitudinally extending attachment flanges, each attachment flange projecting inward from the outer wall and terminating in an inner edge, each attachment flange having a width, the attachment flanges being positioned between the parallel sidewalls of the inner member with each attachment flange overlapping and joining one of the parallel sidewalls so that the inner and outer members are effectively joined together to form a fluid passage, and wherein the inner edges are spaced apart from each other a distance less than the width of each of the flow tubes so that the ends of the flow tubes contact the inner edges of the attachment flanges when the tubes are inserted into the openings of the inner wall; and a fluid partition plate which extends across the fluid passage for diverting fluid flow through the fluid passage.

2. The heat exchanger of claim 1, wherein:

the outer member has a pair of longitudinally extending sidewall retaining members projecting inward from the outer wall, the attachment flanges being located between and spaced apart from the sidewall retaining members to form a longitudinally extending groove between each of the retaining members and the attachment flanges, the longitudinally extending grooves receiving the outer edges of the parallel sidewalls when the inner and outer members are joined together.

3. The heat exchanger of claim 1, further comprising:

a mounting flange which projects outward from the outer wall of the outer member to facilitate the mounting of the heat exchanger to an appropriate support structure.

4. The heat exchanger of claim 3, wherein:

the mounting flange is located in the center of the outer wall.

5. The heat exchanger of claim 3, wherein:

the mounting flange is located to one side of the outer wall.

6. The heat exchanger of claim 1, wherein:

the attachment flanges are substantially parallel to each other.

7. The heat exchanger of claim 1, wherein:

each attachment member has a slot extending parallel to the flow tubes.

8. The heat exchanger of claim 7, wherein:

the slot extends completely through the thickness of the attachment flanges.

9. The heat exchanger of claim 7, wherein:

the width of the attachment flanges is less than the width of the sidewalls; and the slots in the attachment flanges each have a length which is less than the width of the attachment flanges.

10. A parallel flow heat exchanger, comprising in combination:

a plurality of substantially flat, parallel flow tubes, each flow tube having a width and opposite ends; and a pair of oppositely disposed headers, the ends of each flow tube being joined to the headers for providing fluid communication between the headers, each header comprising in combination:

an inner member having an inner wall and a pair of longitudinally extending, parallel sidewalls which project outward from opposite sides of the inner wall and terminate in outer edges, each of the sidewalls having a width, the inner wall having a plurality of openings which are longitudinally spaced apart for receiving the ends of the parallel flow tubes;

an outer member having an outer wall and a pair of longitudinally extending attachment flanges, each attachment flange projecting inward from the outer wall and terminating in an inner edge, each attachment flange having a width and a thickness and being provided with a slot extending parallel to the flow tubes, the attachment flanges being positioned between the parallel sidewalls of the inner member with each attachment flange overlapping and joining one of the parallel sidewalls so that the inner and outer members are effectively joined together to form a fluid passage, and wherein the inner edges are spaced apart from each other a distance less than the width of each of the flow tubes so that the ends of the flow tubes contact the inner edges of the attachment flanges when the tubes are inserted into the openings of the inner wall; and a fluid partition plate extending across the fluid passage for diverting fluid flow through the fluid passage, the fluid partition plate having side edges which are received in the slots of the attachment flanges.

11. The heat exchanger of claim 10, wherein:

the outer member has a pair of longitudinally extending sidewall retaining members projecting inward from the outer wall, the attachment flanges being located between and spaced apart from the sidewall retaining members to form a longitudinally extending groove between each of the retaining members and the attachment flanges, the longitudinally extending grooves receiving the outer edges of the parallel sidewalls when the inner and outer members are joined together.

12. The heat exchanger of claim 10, further comprising:

a mounting flange which projects outward from the outer wall of the outer member to facilitate the mounting of the heat exchanger to an appropriate support structure.

13. The heat exchanger of claim 10, wherein:

the attachment flanges are substantially parallel to each other.

14. The heat exchanger of claim 10, wherein:

the slots extend completely through the thickness of the attachment flanges.

15. The heat exchanger of claim 10, wherein:

the width of the attachment flanges is less than the width of the sidewalls; and the slots in the attachment flanges each have a length which is less than the width of the attachment flanges.

16. A parallel flow heat exchanger, comprising in combination:

a plurality of substantially flat, parallel flow tubes, each flow tube having a width and opposite ends; and a pair of oppositely disposed headers, the ends of each flow tube being joined to the headers for providing fluid communication between the headers, each header comprising in combination:

an inner member having an inner wall and a pair of longitudinally extending, parallel sidewalls which project outward from opposite sides of the inner wall and terminate in outer edges, each of the sidewalls having a width, the inner wall having a plurality of openings which are longitudinally spaced apart for receiving the ends of the parallel flow tubes;

an outer member having an outer wall and a pair of longitudinally extending attachment flanges, each attachment flange projecting inward from the outer wall and terminating in an inner edge, the attachment flanges having a width and being provided with a slot extending parallel to the flow tubes, the attachment flanges being positioned between the parallel sidewalls of the inner member with each attachment flange overlapping and joining one of the parallel sidewalls so that the inner and outer members are effectively joined together to form a fluid passage, the outer member having a pair of longitudinally extending sidewall retaining members projecting inward from the outer wall, the attachment flanges being located between and spaced apart from the sidewall retaining members to form a longitudinally extending groove between each of the retaining members and the attachment flanges, the longitudinally extending grooves receiving the outer edges of the parallel sidewalls when the inner and outer members are joined together, and wherein the inner edges are spaced apart from each other a distance less than the width of each of the flow tubes so that the ends of the flow tubes contact the inner edges of the attachment flanges when the tubes are inserted into the openings of the inner wall;

a fluid partition plate which extends across the fluid passage for diverting fluid flow through the fluid passage, the fluid partition plate having side edges which are received in the slots of the attachment flanges; and a mounting flange which projects outward from the outer wall of the outer member to facilitate the mounting of the heat exchanger to an appropriate support structure.

17. The heat exchanger of claim 16, wherein:

the attachment flanges are substantially parallel to each other.

18. The heat exchanger of claim 16, wherein:

the width of the attachment flanges is less than the width of the sidewalls; and the slots in the attachment flanges each have a length which is less than the width of the attachment flanges.

* * * * *